US011812834B2

(12) United States Patent
Seo

(10) Patent No.: US 11,812,834 B2
(45) Date of Patent: Nov. 14, 2023

(54) ULTRAVIOLET CURING APPARATUS FOR NAIL ART

(71) Applicant: Jae In Seo, Cheongju-si (KR)

(72) Inventor: Jae In Seo, Cheongju-si (KR)

( * ) Notice: Subject to any disclaimer, the term of this patent is extended or adjusted under 35 U.S.C. 154(b) by 482 days.

(21) Appl. No.: 17/214,728

(22) Filed: Mar. 26, 2021

(65) Prior Publication Data

US 2021/0330054 A1 Oct. 28, 2021

(51) Int. Cl.
*A45D 29/00* (2006.01)

(52) U.S. Cl.
CPC ..... *A45D 29/00* (2013.01); *A45D 2200/205* (2013.01)

(58) Field of Classification Search
CPC .. A45D 29/00; A45D 2200/205; A45D 29/18; F26B 3/28; G02B 5/281; G02B 19/0047
See application file for complete search history.

(56) References Cited

U.S. PATENT DOCUMENTS 8,450,705 B1 * 5/2013 Chen ..... A45D 29/00 250/492.1
10,016,043 B1 * 7/2018 Cheng ..... F26B 9/003
11,641,919 B2 * 5/2023 Vu ..... A45D 29/00 132/73
2011/0036997 A1 * 2/2011 Lai ..... A45D 29/00 250/492.1
2013/0134447 A1 * 5/2013 Pan ..... A45D 29/00 257/E33.06
2015/0289627 A1 * 10/2015 Chang ..... A45D 29/00 34/275
2016/0095409 A1 * 4/2016 Jih ..... A45D 29/00 34/202
2016/0220006 A1 * 8/2016 Le ..... A45D 29/18
2018/0276230 A1 * 9/2018 Ouyang ..... A45D 44/005
2018/0325234 A1 * 11/2018 Hsieh ..... H05B 47/195
2019/0281946 A1 * 9/2019 Kim ..... A45D 29/18
2021/0085054 A1 * 3/2021 Vu ..... F21V 7/0075
2021/0112941 A1 * 4/2021 Tan ..... H05G 2/00
2021/0161271 A1 * 6/2021 Cheng ..... A45D 29/00
(Continued)

FOREIGN PATENT DOCUMENTS

DE 202005018015 U1 * 2/2006 ..... A45D 29/00
JP 2013-212326 A 10/2013
(Continued)

*Primary Examiner* — David A Vanore
(74) *Attorney, Agent, or Firm* — Han's Law Office

(57) ABSTRACT

Disclosed is an ultraviolet (UV) curing apparatus for nail art, which is configured to focus-irradiate UV light to a curing material coated on fingernails or toenails and to quickly cure the curing material. The disclosed UV curing apparatus comprises: a housing having a receiving space in which user's fingernails or toenails are received; a light source, installed in the housing, for irradiating UV light rays; an optical module provided with a focusing lens for focusing the light rays irradiated from the light source to a target position in the receiving space; and a scanning unit, installed in the housing, for driving the optical module to be capable of reciprocating within the housing in one scanning direction, to allow the target position to move to the entire region of user's fingernails or toenails received in the receiving space.

9 Claims, 15 Drawing Sheets

(56) References Cited

U.S. PATENT DOCUMENTS

| | | | | |
|---|---|---|---|---|
| 2021/0330054 | A1* | 10/2021 | Seo | A45D 29/00 |
| 2023/0024415 | A1* | 1/2023 | Haile | A45D 44/02 |

FOREIGN PATENT DOCUMENTS

| | | | | | |
|---|---|---|---|---|---|
| JP | 2018108340 | A | * | 7/2018 | A45D 29/18 |
| JP | 2018-108340 | A | | 7/2019 | |
| KR | 1012558010000 | B1 | | 4/2013 | |
| KR | 1013418840000 | B1 | | 12/2013 | |
| KR | 1017264390000 | B1 | | 4/2017 | |
| KR | 1020853500000 | B1 | | 3/2020 | |
| KR | 102193466 | B1 | * | 12/2020 | A45D 29/00 |
| KR | 102414264 | B1 | * | 6/2022 | G06T 7/593 |
| WO | WO-2005120286 | A1 | * | 12/2005 | A45D 29/00 |
| WO | WO-2013048001 | A1 | * | 4/2013 | A45D 29/00 |
| WO | WO-2014051276 | A1 | * | 4/2014 | A45D 29/00 |

* cited by examiner

[FIG. 1]
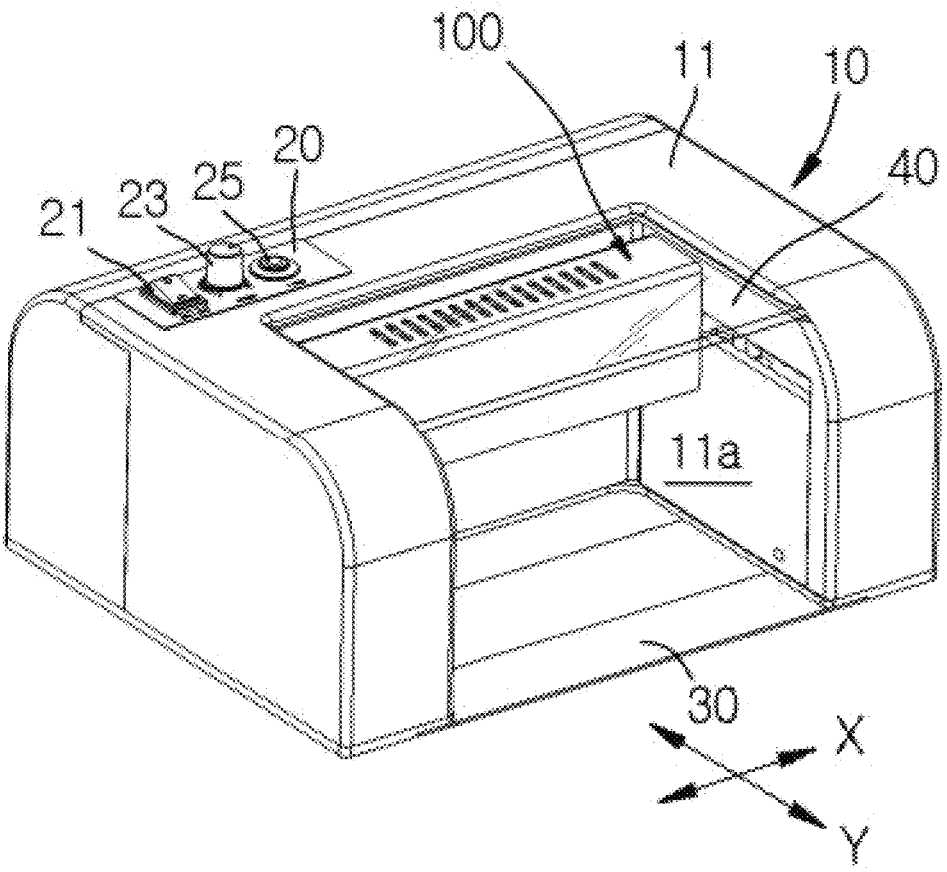

[FIG. 2]
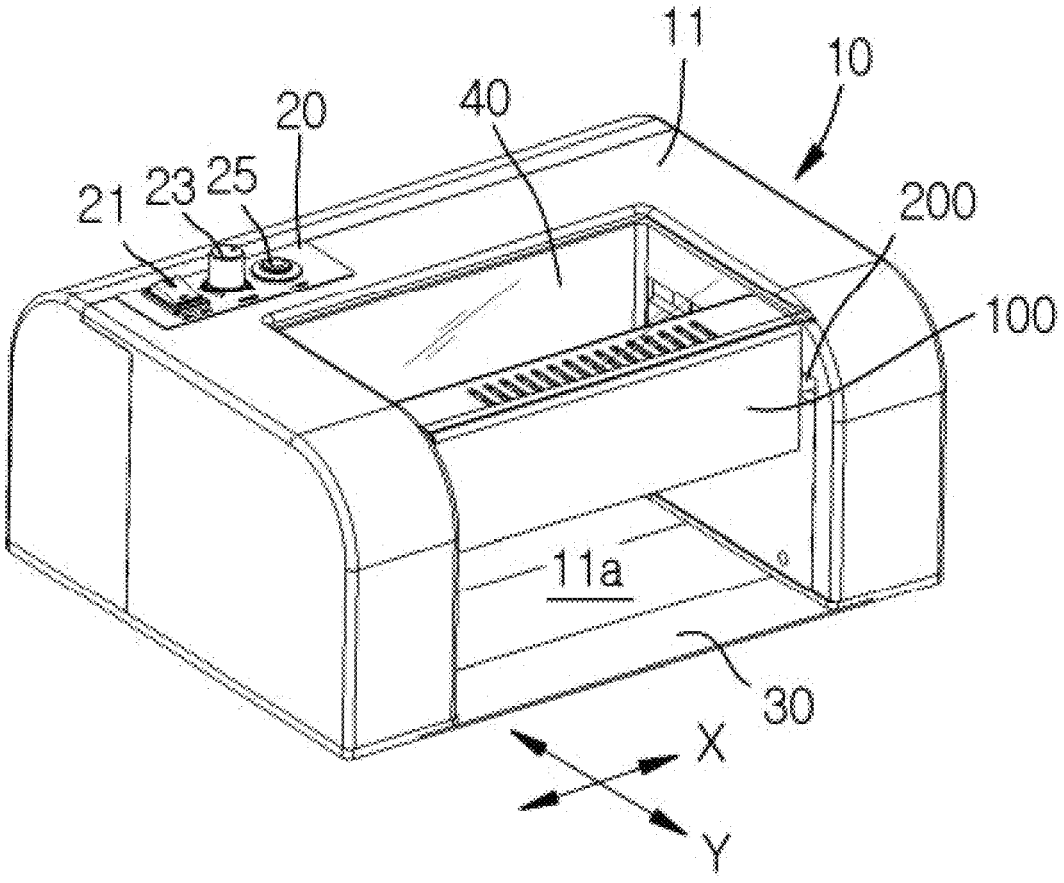

[FIG. 3]
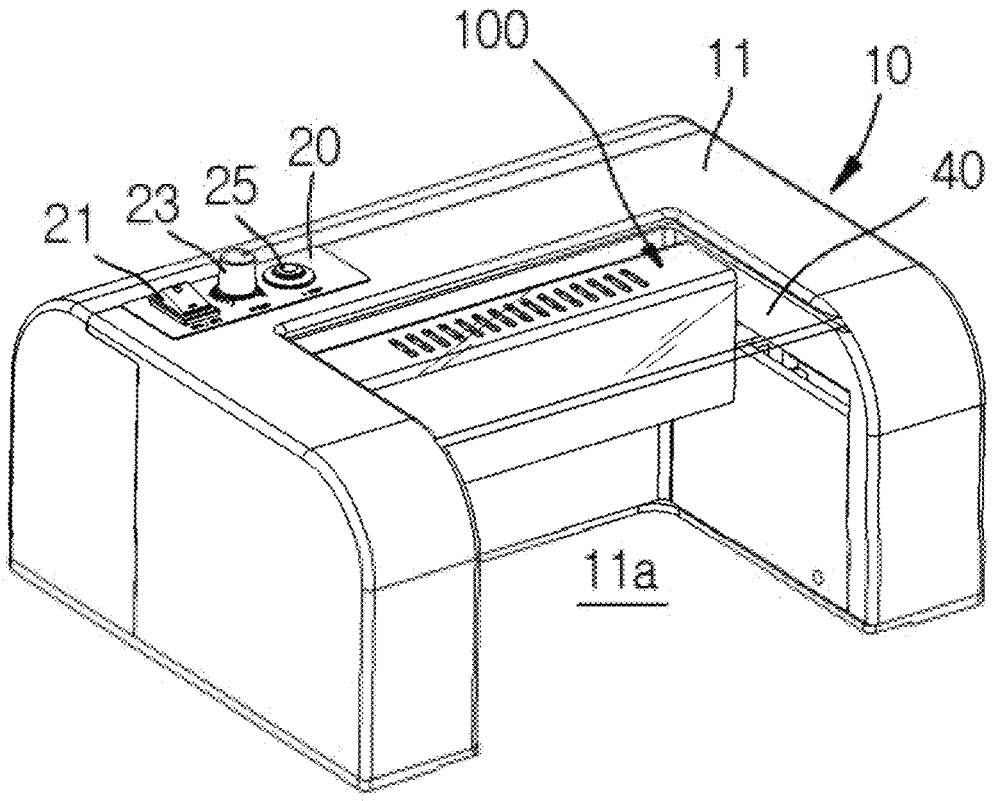

[FIG. 4]
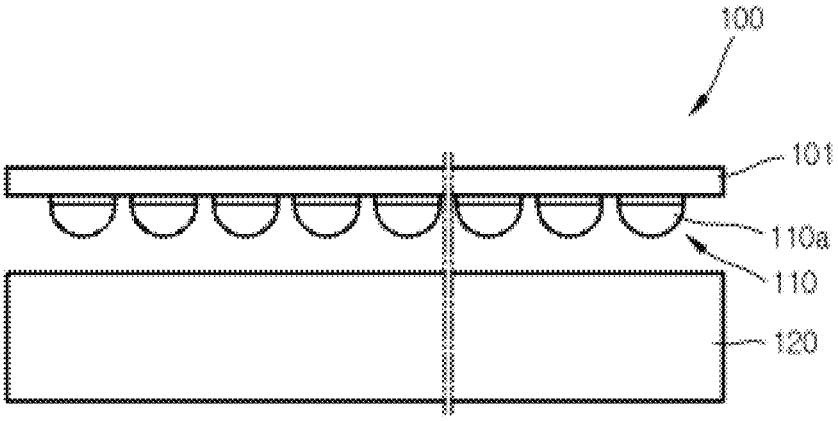

[FIG. 5A]
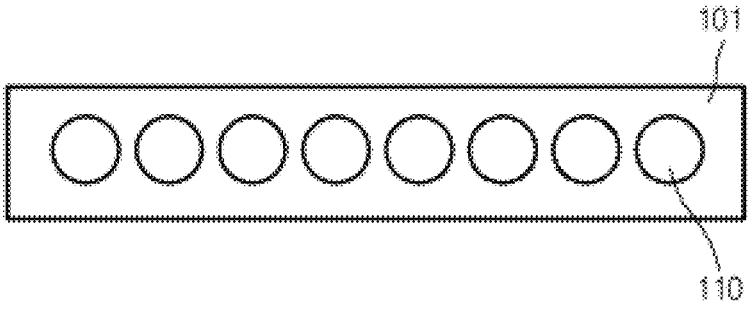
[FIG. 5B]
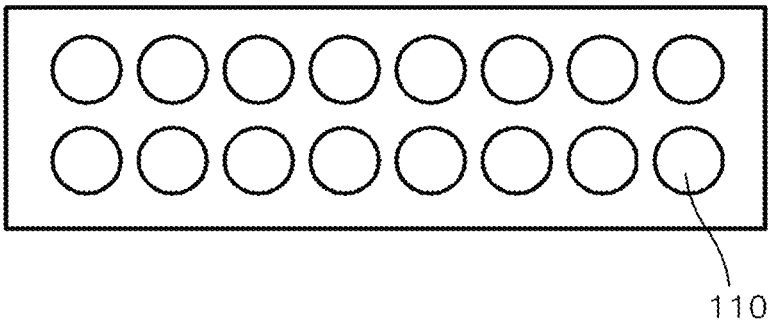
[FIG. 5C]
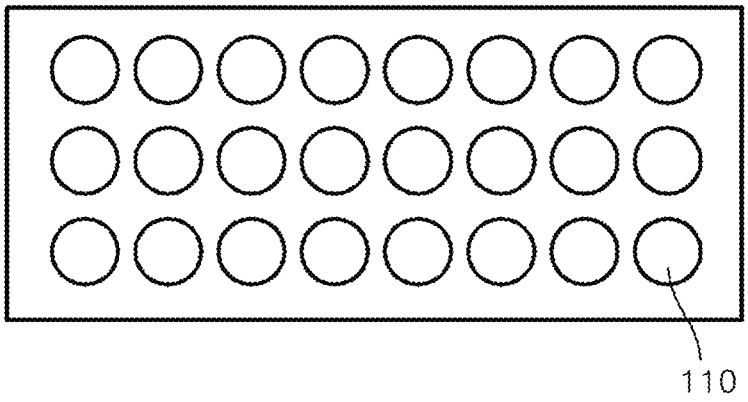

[FIG. 6A]
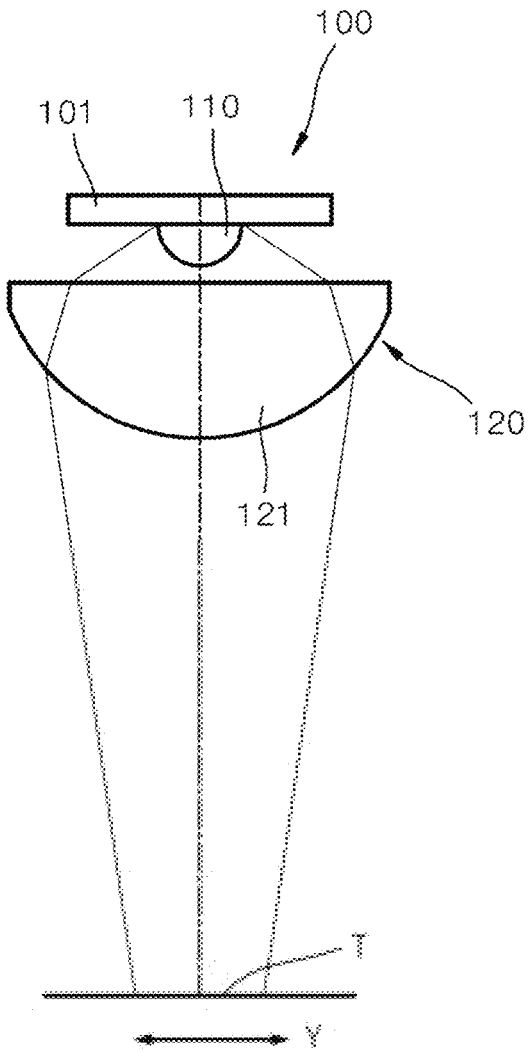

[FIG. 6B]
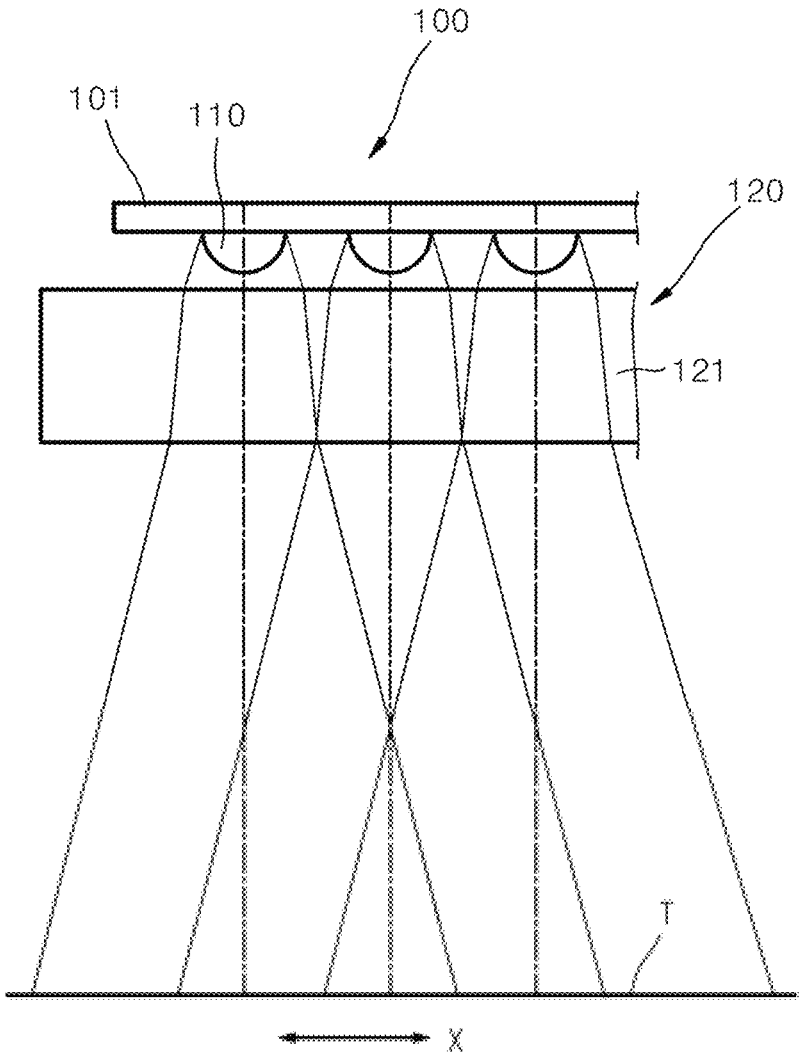

[FIG. 7]
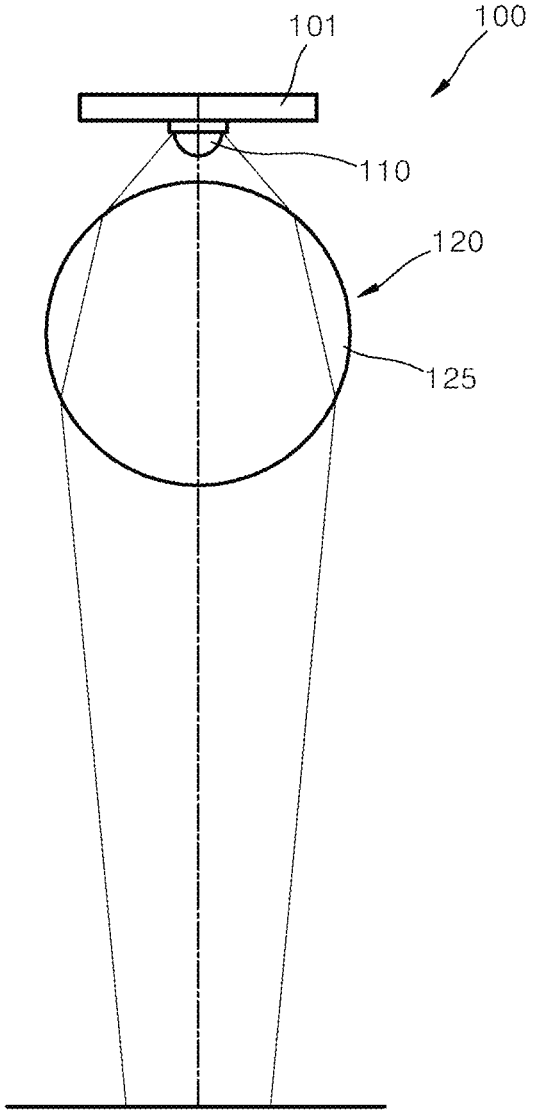

[FIG. 8]
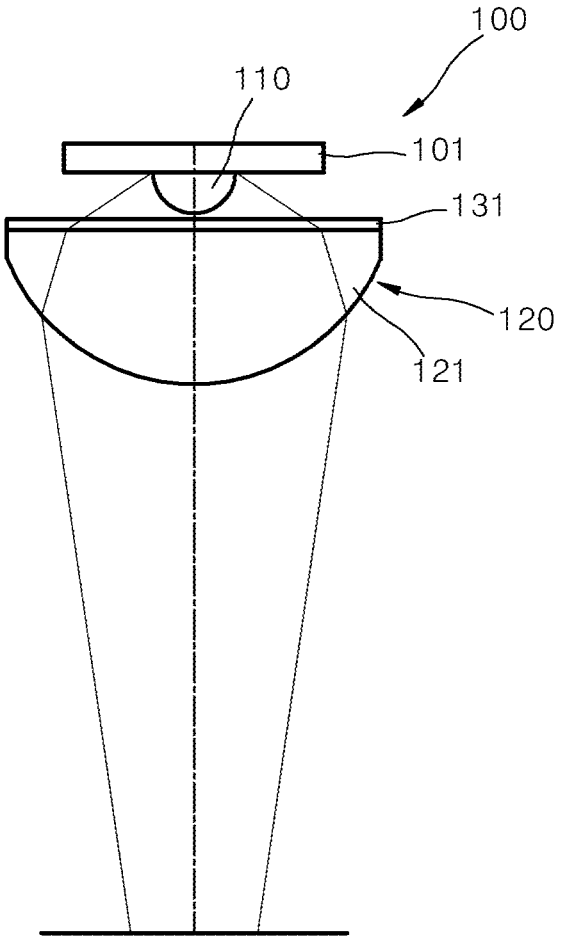

[FIG. 9]
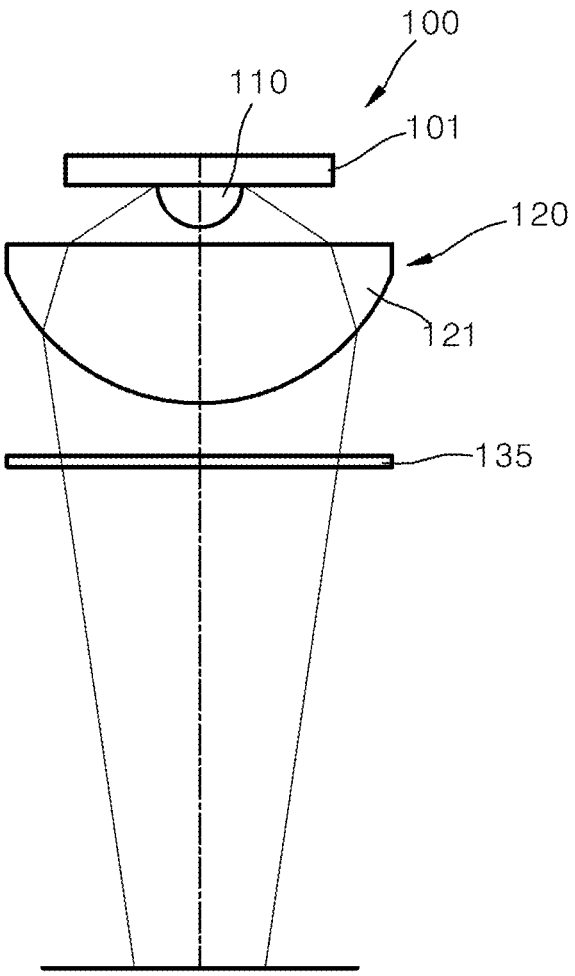

[FIG. 10]
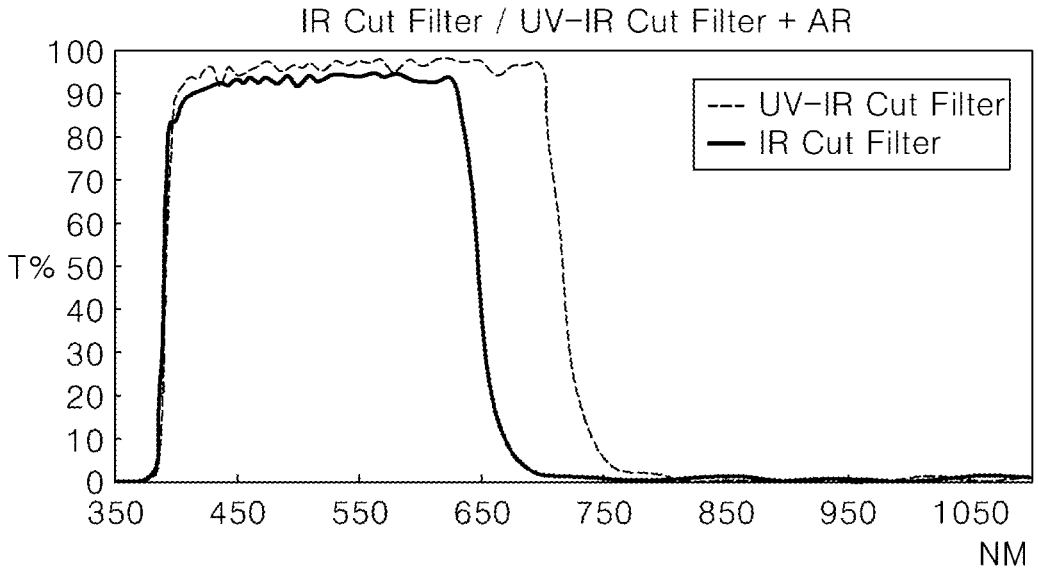
[FIG. 11]
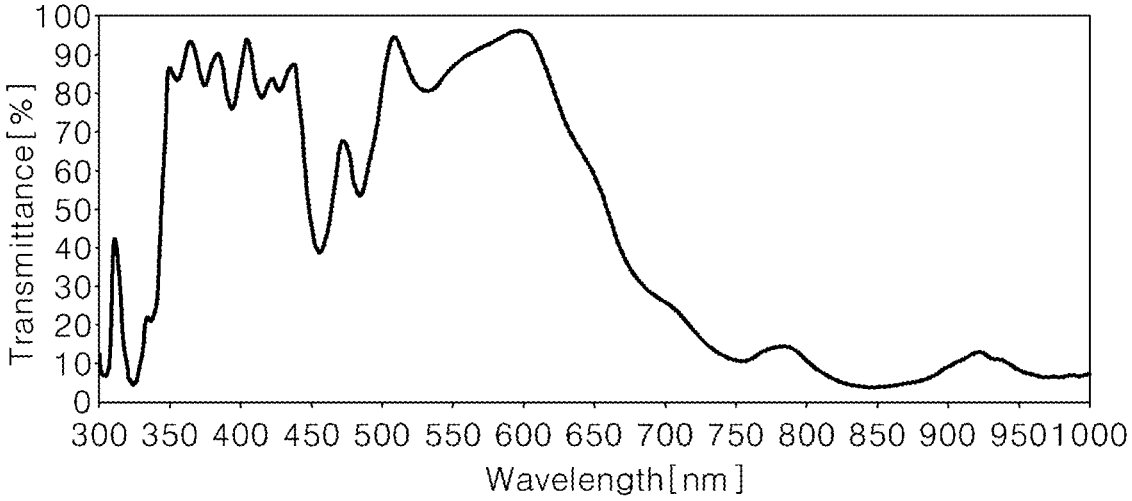

[FIG. 12]
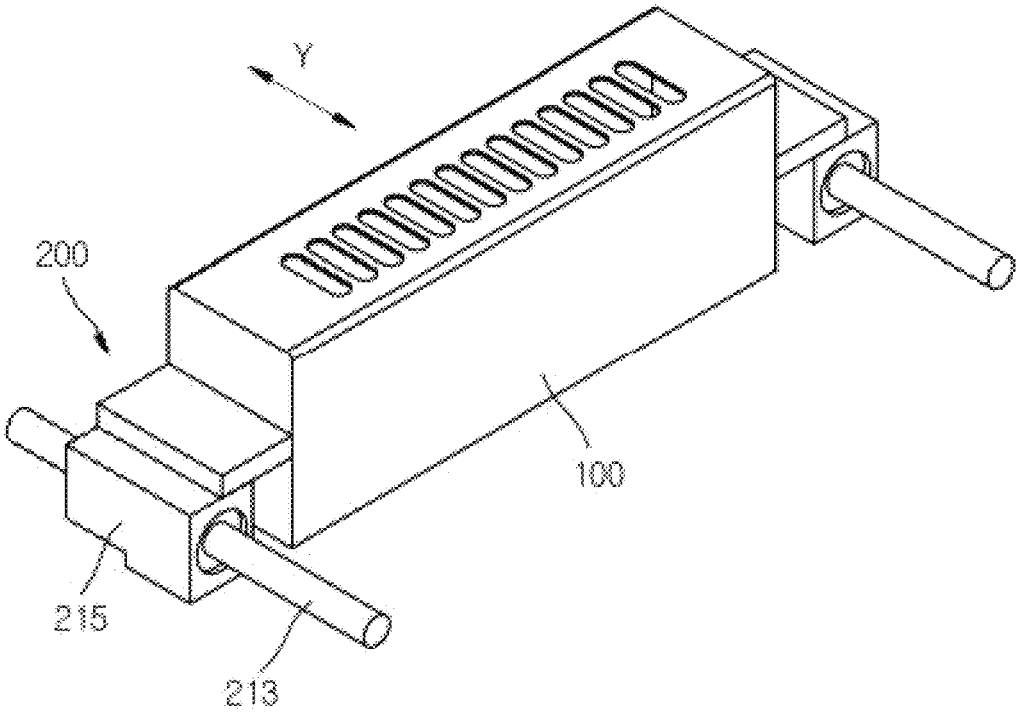
[FIG. 13]
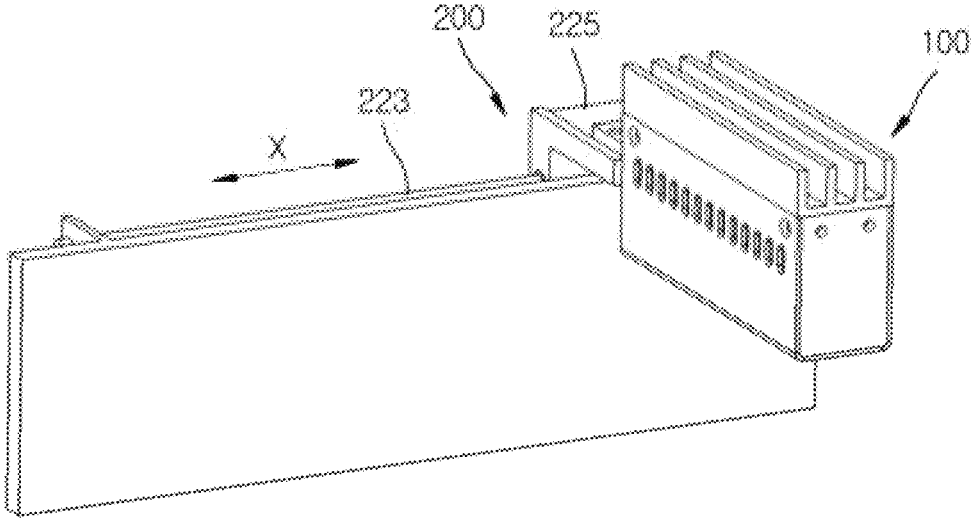

[FIG. 14]
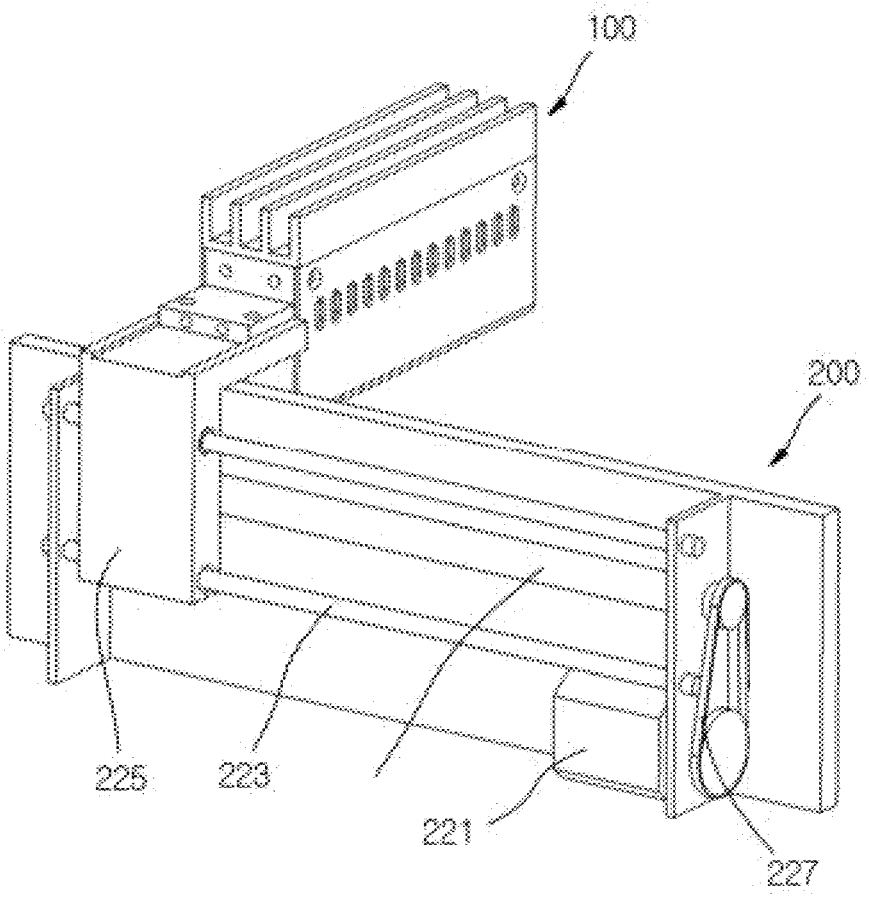

[FIG. 15]
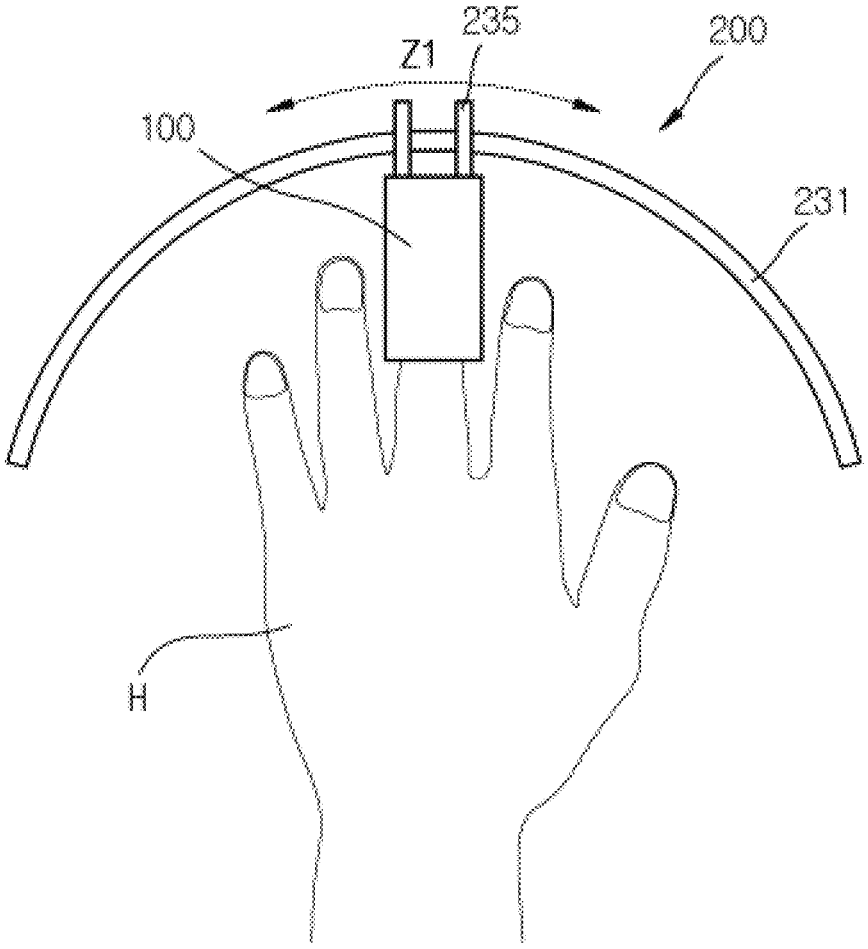

[FIG. 16]
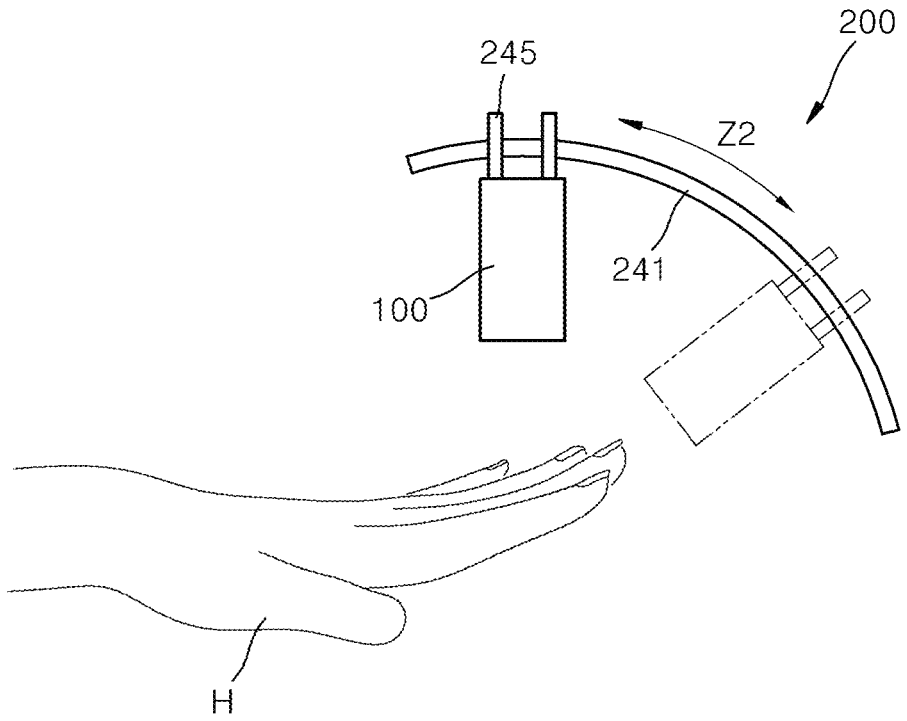
[FIG. 17]
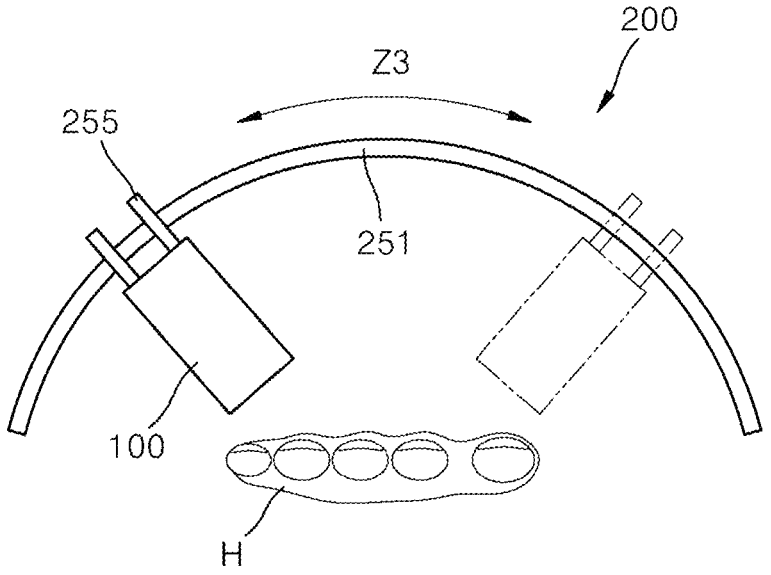

ULTRAVIOLET CURING APPARATUS FOR NAIL ART

CROSS-REFERENCE TO RELATED APPLICATION

This application claims the benefit of Korean Patent Application No. 10-2020-0051601, filed on Apr. 28, 2020, in the Korean Intellectual Property Office, the disclosure of which is incorporated herein in its entirety by reference.

BACKGROUND

1. Field

The present disclosure relates to an ultraviolet (UV) curing apparatus for nail art, and more particularly, to a UV curing apparatus for nail art, which is configured to focus-irradiate UV light to a curing material coated on fingernails or toenails and to quickly cure the curing material.

2. Description of the Related Art

Nail art generally refers to application of nail polish or gel to a fingernail or a toenail in various ways or decoration of a fingernail or toenail with accessories, etc.

Recently, UV nail gel having better curing performance than nail polish is being widely used as a nail-art material. The UV nail gel has several advantages, including being harmless to a human body, having no irritating smell, no discoloration caused even when exposed to light, and having excellent gloss, and high flexibility to be unreadily to be broken. In order to cure a curing material, such as UV nail gel, a UV curing apparatus for nail art is required.

A general UV curing apparatus for nail art is lit up using a number of UV lamps installed inside a housing, a fingernail or toenail coated with the curing material is inserted into the housing and a curing material is then cured using UV light for a predetermined time.

In the general UV curing apparatus, since light having a variety of wavelengths as well as light having a specific wavelength are emitted, skin aging may be caused. In addition, since the light emitted from a UV lamp having a weak output is irradiated into a curing material without focusing the light using a separate optical element, a curing time may be prolonged. In addition, since a plurality of UV lamps are fixedly installed inside a housing, fingertips need to be inserted into locations of the UV lamps. In such a case, trimmed nails may be scratched by the inner wall of the housing, which may spoil the trimmed nails.

SUMMARY

In consideration of the above problems, the present disclosure provides an ultraviolet (UV) curing apparatus for nail art, which is configured to shorten a curing time by focus-irradiating UV light to a curing material coated on a fingernail or toenail, to irradiate UV light into the entire region of an object to be cured, and to prevent the light harmful to a human body.

To achieve the above objectives, provided is an ultraviolet (UV) curing apparatus for nail art according to the present disclosure, comprising: a housing having a receiving space in which user's fingernails or toenails are received; a light source, installed in the housing, for irradiating UV light; an optical module provided with a focusing lens for focusing the light irradiated from the light source to a target position in the receiving space; and a scanning unit, installed in the housing, for driving the optical module to be capable of reciprocating within the housing in one scanning direction, to allow the target position to move to the entire region of user's fingernails or toenails received in the receiving space.

The housing may include: a housing body having the receiving space formed therein; and an operation unit, installed on the housing body, for controlling power to be on/off, and adjusting a scanning speed of the scanning unit.

In addition, the housing may further include a support frame detachably installed with respect to a lower portion of the receiving space.

In addition, the housing may further include a window formed on the receiving space and made of a transparent or semi-transparent material, and may be configured to externally identify the operation states of the scanning unit and the optical module.

In addition, the light source may include a plurality of light sources arranged to be spaced a predetermined distance apart from each other in a direction crossing the scanning direction, the plurality of light sources being arranged in one or more columns in the scanning direction.

In addition, the focusing lens may include one or more cylindrical lenses arranged in the direction crossing the scanning direction so as to focus the light irradiated in the scanning direction. Here, in a case where the plurality of light sources are arranged in multiple columns in the scanning direction, the cylindrical lenses may include a plurality of cylindrical lenses arranged along the columns in which the plurality of light sources are arranged.

The optical module may further include a heat-blocking optical filter for blocking light in the infrared band. The heat-blocking optical filter may be integrally coated on at least one surface of the focusing lens or may be located between the focusing lens and the target position.

The scanning unit may drive the optical module to be capable of reciprocating in any one of a first direction parallel with a direction in which the user's fingernails or toenails are inserted, a second direction perpendicular to the direction in which the user's fingernails or toenails are inserted, and a third direction that is an arcuate direction defined by fingertips of user's fingernails or toenails positioned in the receiving space.

Here, the scanning unit may include a drive source for supplying a driving force; at least one guide member disposed in any one of the first to third directions; a mount installed so as to reciprocate along the guide member, and having the optical module mounted thereon; and a power transmitting unit for transmitting the driving force supplied from the drive source to the mount.

The aforementioned UV curing apparatus for nail art according to the present disclosure has the following effects.

First, since an optical element for focusing incident light is provided along the traveling path of the light irradiated from the light source, UV light may be focused and irradiated into a curing material applied to fingernails or toenails. Thus, the amount of the light irradiated into the curing material may be increased, thereby significantly shortening the curing time, even without increasing the output of the light irradiated from the light source.

Second, the light source and the optical element (focusing lens) are driven for scanning in a predetermined direction, thereby allowing the light to be irradiated to the entire region of an object to be cured even without moving a user's hand or foot inserted into the apparatus. In addition, since the hand or foot does not have to be inserted deep into the housing, it is possible to prevent trimmed fingernails or toenails from being spoiled due to scratches by the inner wall of the housing.

Third, a filter member for blocking light having wavelengths other than the wavelength required to cure the curing material is provided along the traveling path of the light irradiated from the light source, thereby preventing skin damages by blocking the light harmful to the human body.

BRIEF DESCRIPTION OF THE DRAWINGS

The present disclosure may be embodied in various forms and the details of the preferred embodiments of the present disclosure will be described in the subsequent content with reference to the accompanying drawings. The drawings show and depict only the preferred embodiments of the disclosure and shall not be considered as limitations to the scope of the present disclosure.

FIG. 1 is a perspective view showing a UV curing apparatus for nail art, according to an embodiment of the present disclosure.

FIG. 2 is a perspective view showing an optical module of FIG. 1 after being moved by a scanning unit.

FIG. 3 is a perspective view showing a use example of the UV curing apparatus for nail art, according to an embodiment of the present disclosure.

FIG. 4 is a schematic view showing the optical module of the UV curing apparatus for nail art, according to the present disclosure.

FIGS. 5A to 5C are schematic views showing the arrangement relationship between light sources and a focusing lens in the optical module of FIG. 4, according to modified examples of the present disclosure.

FIGS. 6A and 6B are views showing the optical arrangement of each of the light sources and the focusing lens according to a first example of the optical module of FIG. 4.

FIG. 7 is a view showing the optical arrangement of the light source and the focusing lens according to a second example of the optical module of FIG. 4.

FIG. 8 is a view showing the optical arrangement of a light source and a focusing lens according to a third example of the optical module of FIG. 4.

FIG. 9 is a view showing the optical arrangement of a light source and a focusing lens according to a fourth example of the optical module of FIG. 4.

FIG. 10 is a graph showing a change in the wavelength-dependent transmittance when an infrared (IR) cut filter (solid line) is employed and when an ultraviolet-infrared (UV-IR) cut filter (dashed line) is employed.

FIG. 11 is a graph showing a change in the wavelength-dependent transmittance when optical filters shown in FIGS. 8 and 9 are employed.

FIG. 12 is a perspective view showing a first example of a scanning unit of the UV curing apparatus for nail art according to the present disclosure.

FIGS. 13 and 14 are a perspective front view and a perspective rear view showing a second example of a scanning unit of the UV curing apparatus for nail art, according to the present disclosure.

FIGS. 15 to 17 are schematic views showing third to fifth examples of scanning units of the UV curing apparatus for nail art according to the present disclosure.

DETAILED DESCRIPTION

Hereinafter, an ultraviolet (UV) curing apparatus for nail art according to an example embodiment of the present disclosure will be described in greater detail with reference to the accompanying drawings.

Prior to description of the present disclosure, this is not intended to limit the present inventive concept to particular modes of practice, and it is to be appreciated that all changes, equivalents, and substitutes that do not depart from the spirit and technical scope are encompassed in the present inventive concept.

In addition, in the accompanying drawings of the present disclosure, like numerals refer to like elements throughout.

FIG. 1 is a perspective view showing a UV curing apparatus for nail art, according to an embodiment of the present disclosure, FIG. 2 is a perspective view showing an optical module of FIG. 1 after being moved by a scanning unit, and FIG. 3 is a perspective view showing a use example of the UV curing apparatus for nail art, according to an embodiment of the present disclosure.

Referring to FIGS. 1 to 3, the UV curing apparatus for nail art, according to an embodiment of the present disclosure, includes a housing 10, an optical module 100, and a scanning unit 200.

The housing 10 may include a housing body 11, and an operation unit 20 installed in the housing body 11. The housing body 11 has a receiving space 11*a* in which user's fingernails or toenails having a curing material, such as an UV gel, coated thereon are allowed to enter. The operation unit 20, for operating the UV curing apparatus for nail art according to an example embodiment of the present disclosure, may include a power switch 21 which turns the power on/off, a speed controller 23 for controlling a scanning speed of the scanning unit 200, and a step switch 25. The step switch 25 is a switch for selecting each step when to use by programming the operating mode in various steps.

In addition, the housing 10 may also include a support frame 30. The support frame 30 may be detachably installed relative to the housing body 11. That is, when the UV curing apparatus for nail art according to the present disclosure is intended to be used for toenails, a user's foot is first placed at a predetermined location, and the housing 10 is then placed such that the receiving space 11*a* is positioned on the user's foot in a state in which the support frame (30 of FIG. 1) is removed, as shown in FIG. 3. Accordingly, convenience in use of the UV curing apparatus for nail art according to the present disclosure can be enhanced.

In addition, the housing 10 may further include a window 40 formed on the receiving space 11*a*. The window 40 may be made of a transparent or semi-transparent material so as to externally identify the operation state of the optical module 100. In addition, the window 40 may include a material capable of blocking light of a predetermined wavelength, for example, UV light.

As such, by including the window 40, it is possible to visually identify whether the optical module 100 normally operates or not, and to prevent the UV light from leaking out during a scanning operation. Therefore, the effect of the UV light exerted on the user's eyes or skin can be minimized.

The optical module 100 irradiates UV light to the fingernails or toenails positioned in the receiving space 11*a* to cure the curing material. To this end, the optical module 100 is movably installed in the housing 10. For example, the optical module 100 is allowed to reciprocate by means of the scanning unit 200 along the Y-axis direction from the location shown in FIG. 1 to the location shown in FIG. 2.

FIG. 4 is a schematic view showing the optical module of the UV curing apparatus for nail art, according to the present disclosure, and FIGS. 5A to 5C are schematic views showing the arrangement relationship between light sources and a focusing lens in the optical module of FIG. 4, according to modified examples of the present disclosure.

Referring to FIGS. 4 to 5C, the optical module 100 may include a light source 110 for irradiating UV light, and a focusing lens 120. The light source 110 for irradiating UV light, may include a plurality of LEDs integrated on a substrate 101. That is, the light source 110 may include a plurality of light sources 110*a* arranged to be spaced a predetermined distance apart from each other in a sub-scanning direction (X direction of FIG. 1) crossing the scanning direction (Y direction of FIG. 1), and a plurality of light sources arranged in one column or multiple columns in the scanning direction, as shown in FIGS. 4 and 5A to 5C. Here, the scanning direction refers to a direction in which the scanning unit 200 to be described later moves, and corresponds to the Y direction in FIG. 1, the X direction in FIG. 13, and the Z axis in FIG. 15.

Here, UV light may mean light in a wavelength range of 365 nm to 430 nm. In addition, the light source 110 may be comprise not only an LED element, but also a laser diode, a fluorescent lamp such as a cold cathode fluorescent lamp (CCFL), and the like.

In addition, the light source 110 may be arranged in a column in the scanning direction, as shown in FIG. 5A, and may be arranged in two columns and three columns in the scanning direction, as shown in FIGS. 5B and 5C, respectively, as necessary.

The focusing lens 120 focuses the light irradiated from the light source 110 onto a target position T in the receiving space 11*a*. Here, the light spot focused on the target position T has a size enough to cover portions of user's fingernails or toenails. By focusing the light through the focusing lens 120, the amount of the focused light irradiated into the target position per unit hour can be increased. Therefore, even if the light is irradiated into the target position for a short time, high-speed curing can be achieved. According to the present disclosure, the light amount can be improved by providing the focusing lens 120, thereby shortening the curing time to 1/20 or less, compared to a curing apparatus without a focusing lens.

FIGS. 6A and 6B are views showing the optical arrangement of each of the light sources and the focusing lens according to a first example of the optical module of FIG. 4.

Referring to the drawings, the focusing lens 120 may include at least one cylindrical lens 121 arranged in the sub-scanning direction (X direction of FIG. 6B) so as to focus the light irradiated in the scanning direction. Here, the cylindrical lens 121 may be a planoconvex spherical or non-spherical cylindrical lens having a planar light-entering surface.

Referring to FIGS. 6A and 6B, the cylindrical lens 121 focuses incident light in the scanning direction (the Y direction) and refracts and transmits the incident light without focusing the incident light in the sub-scanning direction (the X direction). By arranging the cylindrical lens 121 in such a manner, the incident light is focused in the scanning direction, thereby forming a light spot having a linear oval shape, focused in the sub-scanning direction. Therefore, the light is irradiated into the entire region of fingernails or toenails by moving once in the scanning direction by the scanning unit 200, thereby entirely curing the curing material for the fingernails or toenails.

Although the planoconvex cylindrical lens having a planar light-entering surface is illustrated by way of example in the present embodiment, embodiments of the present disclosure are not limited thereto, and a planoconvex cylindrical lens having a planar light-emitting surface may also be applied.

FIG. 7 is a view showing the optical arrangement of the light source and the focusing lens according to a second example of the optical module of FIG. 4. Referring to FIG. 7, the focusing lens may be configured by a biconvex cylindrical lens 125 having a light-entering surface and a light-emitting surface both having convex sections.

In addition, as shown in FIG. 5C, when the plurality of light sources are arranged in multiple columns in the scanning direction, the cylindrical lenses 121 and 125 may include a plurality of cylindrical lenses arranged to be spaced apart from each other along the columns in which plurality of light sources are arranged.

FIGS. 8 and 9 are views showing the optical arrangement of a light source and a focusing lens according to third and fourth examples of the optical module of FIG. 4.

Referring to FIGS. 8 and 9, the optical module may further include heat-blocking optical filters 131 and 135 for lowering temperatures by blocking the light in the infrared band. Here, when UV light is irradiated from the light source 110 and then focused through the focusing lens 120, the light focused on the target position is instantaneously generated as high-temperature heat. Here, when the generated heat temperature is 50° C. or higher, a burn may be caused due to the heat. The heat-blocking optical filters 131 and 135 may block IR light mainly causing the heat to lower the temperature to less than 0° C., thereby preventing a user from getting a burn due to heat. The heat-blocking optical filter 131 can be formed by being integrally coated on at least one surface of the focusing lens 120, as shown in FIG. 8. In addition, as shown in FIG. 9, the heat-blocking optical filter 135 may be positioned on the optical path between the focusing lens 120 and the target position.

FIG. 10 is a graph showing a change in the wavelength-dependent transmittance when an infrared (IR) cut filter (solid line) is employed and when an ultraviolet-infrared (UV-IR) cut filter (dashed line) is employed. Referring to FIG. 10, when an IR cut filter is employed, as indicated by a solid line, the transmittance of the light having a longer wavelength than 650 nm, that is, the light of a wavelength in the IR band, is sharply reduced, and the transmittance of the light having a wavelength of 700 nm or higher, approaches zero. Therefore, the IR cut filter is capable of blocking the heat based on the IR light. However, when an UV-IR cut filter is employed, the light having a wavelength of about 700 nm in the IR band is transmitted, and thus the efficiency of blocking heat based on the IR light is lowered. In consideration of the foregoing, the heat-blocking optical filter 131 according to the present disclosure may employ an IR cut filter for blocking the light having a wavelength of greater than or equal to 650 nm.

FIG. 11 is a graph showing a change in the wavelength-dependent transmittance when optical filters shown in FIGS. 8 and 9 are employed. Referring to FIG. 11, when the wavelength is 650 nm or greater, the transmittance is lowered to about 50%, and when the wavelength is 700 nm or greater, the transmittance is about 20%. Therefore, the UV curing apparatus for nail art according to the present embodiment employs a heat-blocking optical filter, thereby advantageously preventing a user from getting a burn.

FIG. 12 is a perspective view showing a first example of a scanning unit of the UV curing apparatus for nail art according to the present disclosure. Referring to FIG. 12, the scanning unit 20, installed in the housing 10, drives the optical module 100 to be capable of reciprocating in the housing 10 in one scanning direction (in the Y direction in FIGS. 1 and 2). Accordingly, the target position where a light spot is formed by the optical module 100 may be moved to the entire region of the user's fingernails or toenails received in the receiving space 11*a* along the scanning direction.

That is, the scanning unit 200 according to an embodiment, as shown in FIG. 12, drives the optical module 100 so as to reciprocate in a first direction (a Y-axis direction) parallel with a direction in which user's fingernails or toenails are inserted. To this end, the scanning unit 200 may include a drive source (not shown) for supplying a driving force, at least one guide member 213 disposed in the first direction, and a mount 215 installed on the guide member 213 so as to be capable of reciprocating. Here, the optical module 100 is installed on the mount 215 and is driven to reciprocate along the guide member 213 in the first direction by the driving force supplied from the drive source.

FIGS. 13 and 14 are a perspective front view and a perspective rear view showing a second example of a scanning unit of the UV curing apparatus for nail art, according to the present disclosure.

Referring to FIGS. 13 and 14, the scanning unit 200 drives the optical module 100 to reciprocate in a second direction perpendicular to the direction in which user's fingernails or toenails are inserted. To this end, the scanning unit 200 may include a drive source 221 for supplying a driving force, at least one guide member 223 disposed in the second direction (X-axis direction), a mount 225 installed on guide member 223 so as to reciprocate, and a power transmitting unit 227 for transmitting the driving force supplied from the drive source 221 to the mount 225. Here, the optical module 100 is installed on the mount 225, and is driven to reciprocate along the guide member 223 in the second direction by means of the driving force supplied from the drive source 221 and transmitted from the power transmitting unit 227.

FIG. 15 is a schematic view showing a third example of a scanning unit of the UV curing apparatus for nail art according to the present disclosure.

Referring to FIG. 15, the scanning unit 200 drives the optical module 100 to reciprocate in a third direction (Z1 direction) that is an arcuate direction defined by fingertips of user's fingernails or toenails positioned in the receiving space. For example, when user's hand (H) is inserted into the UV curing apparatus, the optical module 100 of the scanning unit 200 may reciprocate while drawing an arc at a location opposite to user's fingertips in a direction from a thumb to a little finger or vice versa.

To this end, the scanning unit 200 may include may include a drive source (not shown) for supplying a driving force, at least one guide member 231 disposed in an arcuate shape in the third direction, and a mount 235 installed on the guide member 231 so as to reciprocate. Here, the optical module 100 is installed on the mount 235, and is driven to reciprocate along the guide member 231 in the third direction by means of the driving force supplied from the drive source.

FIG. 16 is a schematic view showing a fourth example of a scanning unit of the UV curing apparatus for nail art according to the present disclosure.

Referring to FIG. 16, the scanning unit 200 drives the optical module 100 to reciprocate in a fourth direction (Z2 direction) that is an arculate on user's back of hand or foot positioned in the receiving space. For example, when user's hand (H) is inserted into the UV curing apparatus, the optical module 100 of the scanning unit 200 may reciprocate while drawing an arc at a location opposite to user's fingertips in a direction from the fingertips to the back of the hand or vice versa. That is, the optical module 100 is disposed to be capable of reciprocating on the user's hand (H) in the Y axis direction (see FIG. 1), and may move while drawing an arc in the height direction.

To this end, the scanning unit 200 may include a drive source (not shown) for supplying a driving force, at least one guide member 241 disposed in an arcuate shape in the fourth direction, and a mount 245 installed on the guide member 241 so as to reciprocate. Here, the optical module 100 is installed on the mount 245, and is driven to reciprocate along the guide member 231 in the fourth direction by means of the driving force supplied from the drive source.

FIG. 17 is a schematic view showing a fifth example of a scanning unit of the UV curing apparatus for nail art according to the present disclosure.

Referring to FIG. 17, the scanning unit 200 drives the optical module 100 to reciprocate in a fifth direction (Z3 direction) that is an arcuate direction on fingertips of user's fingernails or toenails positioned in the receiving space. For example, when user's hand (H) is inserted into the UV curing apparatus, the optical module 100 of the scanning unit 200 may reciprocate while drawing an arc at a location opposite to user's fingertips in a direction from a thumb to a little finger or vice versa. That is, the optical module 100 is disposed to be capable of reciprocating on the user's hand (H) in the Y axis direction (see FIG. 1), and may move while drawing an arc in the height direction.

To this end, the scanning unit 200 may include a drive source (not shown) for supplying a driving force, at least one guide member 251 disposed in an arcuate shape in the fifth direction, and a mount 255 installed on the guide member 251 so as to reciprocate. Here, the optical module 100 is installed on the mount 255, and is driven to reciprocate along the guide member 255 in the fifth direction by means of the driving force supplied from the drive source.

As described above, the UV curing apparatus for nail art according to the present disclosure, including a scanning unit, drives an optical module for scanning in a predetermined direction, thereby allowing UV light to be irradiated into the entire region of a curing target even without moving user's hand or foot inserted into the apparatus. In addition, since it is not necessary to insert the user's hand or foot deep into a housing of the apparatus, trimmed fingernails or toenails may be prevented from being spoiled by being scratched by the inner wall of the housing.

While the present disclosure has been specifically described in reference to the preferred embodiments and drawings, it is contemplated that the scope of the invention is defined by the following claim and modifications and equivalents thereof will be made within the spirit of the invention.

What is claimed is:

1. An ultraviolet (UV) curing apparatus for nail art comprising:

a housing having a receiving space in which user's fingernails or toenails are received;

a light source, installed in the housing, for irradiating UV light rays;

an optical module provided with a focusing lens for focusing the light rays irradiated from the light source to a target position in the receiving space; and a scanning unit, installed in the housing, for driving the optical module to be capable of reciprocating within the housing in one scanning direction, to allow the target position to move to the entire region of user's fingernails or toenails received in the receiving space, wherein the light source comprises a plurality of light sources arranged to be spaced a predetermined distance apart from each other in a direction crossing the scanning direction, and a plurality of light sources arranged in one column or multiple columns in the scanning direction, and the focusing lens comprises one or more cylindrical lenses arranged in the direction crossing the scanning direction so as to focus the light rays irradiated in the scanning direction, so that the light rays emitted from the plurality of light sources are irradiated into the target position in an overlapping state in the direction crossing the scanning direction.

2. The UV curing apparatus of claim 1, wherein the housing comprises:

a housing body having the receiving space formed therein; and an operation unit, installed on the housing body, for controlling power to be on/off, and adjusting a scanning speed of the scanning unit.

3. The UV curing apparatus of claim 1, wherein the housing further comprises a support frame detachably installed with respect to a lower portion of the receiving space.

4. The UV curing apparatus of claim 1, wherein the housing further comprises a window formed on the receiving space and made of a transparent or semi-transparent material and is configured to externally identify the operation states of the scanning unit and the optical module.

5. The UV curing apparatus of claim 1, wherein when the plurality of light sources are arranged in multiple columns in the scanning direction, the cylindrical lenses comprise a plurality of cylindrical lenses arranged along the columns in which the plurality of light sources are arranged.

6. The UV curing apparatus of claim 1, wherein the optical module further comprises a heat-blocking optical filter for blocking light in the infrared band.

7. The UV curing apparatus of claim 6, wherein the heat-blocking optical filter is integrally coated on at least one surface of the focusing lens or is located between the focusing lens and the target position.

8. The UV curing apparatus of claim 1, wherein the scanning unit drives the optical module to be capable of reciprocating in any one of a first direction parallel with a direction in which the user's fingernails or toenails are inserted, a second direction perpendicular to the direction in which the user's fingernails or toenails are inserted, and a third direction that is an arcuate direction defined by fingertips of user's fingernails or toenails positioned in the receiving space.

9. The UV curing apparatus of claim 8, wherein the scanning unit comprises:

a drive source for supplying a driving force;

at least one guide member disposed in any one of the first to third directions;

a mount installed so as to reciprocate along the guide member, and having the optical module mounted thereon; and a power transmitting unit for transmitting the driving force supplied from the drive source to the mount.

* * * * *